United States Patent [19]

Gerretz et al.

[11] Patent Number: 4,858,458

[45] Date of Patent: Aug. 22, 1989

[54] DRIVE FOR A PILGER COLD-ROLLING MILL WITH BALANCING OF MASSES AND MOMENTS

[75] Inventors: Josef Gerretz, Viersen; Antonio Hurtado, Duisburg, both of Fed. Rep. of Germany

[73] Assignee: Mannesmann Aktiengesellschaft, Düsseldorf, Fed. Rep. of Germany

[21] Appl. No.: 159,191

[22] Filed: Feb. 23, 1988

[30] Foreign Application Priority Data

Feb. 23, 1987 [DE] Fed. Rep. of Germany ..... 3706129

[51] Int. Cl.[4] ..... B21B 21/00

[52] U.S. Cl. ..... 72/214; 72/249

[58] Field of Search ..... 72/214, 208, 209, 249

[56] References Cited

U.S. PATENT DOCUMENTS

| | | | |
|---|---|---|---|
| 2,924,106 | 2/1960 | Bohm et al. | 72/249 X |
| 3,335,593 | 8/1967 | Zeunert | 72/249 |
| 3,584,489 | 6/1971 | Peytavin | 72/208 |
| 3,890,821 | 6/1975 | Gerretz et al. | 72/208 |
| 4,052,898 | 10/1977 | Miller et al. | 72/208 X |
| 4,386,512 | 6/1983 | Rehag et al. | 72/214 |

FOREIGN PATENT DOCUMENTS

| | | | |
|---|---|---|---|
| 1945872 | 3/1971 | Fed. Rep. of Germany | 72/214 |
| 2312223 | 11/1974 | Fed. Rep. of Germany | 72/214 |
| 2740729 | 10/1979 | Fed. Rep. of Germany . | |
| 3221803 | 12/1983 | Fed. Rep. of Germany | 72/214 |
| 0592472 | 2/1978 | U.S.S.R. | 72/214 |

*Primary Examiner*—Robert L. Spruill
*Assistant Examiner*—Steven B. Katz
*Attorney, Agent, or Firm*—Horst M. Kasper

[57] ABSTRACT

A drive for a pilger cold-rolling mill with mass and torque balancing, where the driven crank, rotating around a vertical axis, is connected via a coupler with a roller frame guided horizontally in a guide and where the coupler assumes, with its total mass, the balancing of momentum and where the crank, with its total mass, assumes the mass balancing. An additional mass $M_z$, which is movable synchronously and parallel to the roller frame and where the center of gravity ($S_M$) is lower than the virtual engagement point ($S_{AG}$) of the centrifugal force of the crank balancing mass (MA), where the product of the force of inertia for accelerating the mass ($M_z$) and of the vertical distance (b) between the center of gravity ($S_M$) and of the mass ($M_z$) and the engagement point ($S_{AG}$) of the centrifugal force of the mass (MA) corresponds to the balancing mass moment obtained as a product of the force of inertia engaging at the center of gravity ($S_{AG}$) at the roller frame and its vertical distance (a) to the point of engagement ($S_{AG}$) of the centrifugal force for improving conventional drives such that the mass moment or moment of inertia is balanced.

20 Claims, 3 Drawing Sheets

DRIVE FOR A PILGER COLD-ROLLING MILL WITH BALANCING OF MASSES AND MOMENTS

BACKGROUND OF THE INVENTION

1. Field of the Invention

The invention relates to a drive for a pilger cold-rolling mill with mass and torque balancing, where a crank is driven and rotates around a vertical axis and is connected to a roller frame horizontally guided via a coupler in a guide and where the coupler, with its total mass, assumes a balancing of moments and where the crank, with its total mass, assumes the mass balancing.

2. Brief Description of the Background of the Invention Including Prior Art

A pilger cold-rolling mill of the kine recited is known from the German Patent Application Laid Out DE-AS No. 2,740,729, where the crank drive is disposed staggered to the side relative to the rolling mill. The crank is thereby connected via a crankshaft throw with the balancing mass disposed above the crank drive for balancing of moments. The balancing mass is disposed phase-shifted relative to the crank. The reciprocating motion back and forth is made possible by a parallel guide. The roller mill is coupled via a long connecting rod which is supported on one side at the crankshaft throw.

The roller frame can be disposed immediately above the crank drive and the coupler can be supported immediately on the crank pin. The coupler can take care of the momentum balancing with its total mass and the crank can take care with its total mass of the balancing of masses. According to this method, the balancing of the masses reduces the mass forces, comprising the forces of inertia and the centrifugal forces, which act via the casing on the foundation and the balancing of momentum reduces the drive torques for the acceleration of the back and forth moving frame mass.

According to these methods, there remains a moment of inertia relative to a horizontal axis, which acts at a right angle relative to the direction of motion of the roller stand. The mass moment torque is generated because the force of inertia engaging at the center of gravity of the roller stand and the centrifugal force of the mass MA engaging in the virtual engagement point, i.e. the center of gravity, are in fact of equal size but are not disposed on one and the same line of action. The vector of the mass moment torque is directed perpendicular to the crank drive axis. There, the size of the moment of inertia is determined from the product of the force of inertia engaging in the center of gravity of the roller mill and its vertical distance relative to the engagement point of the centrifugal force of the mass MA.

German Patent DE No. 3,613,036 teaches a drive for a pilger cold-rolling mill. The reference illustrates the action of the various forces on the moving parts of the reference construction.

According to the invention, an optimum mass balancing is only possible if the moment of inertia recited above is eliminated.

SUMMARY OF THE INVENTION

1. Purposes of the Invention

It is an object of the present invention to provide an improved pilger cold-rolling mill.

It is another object of the invention to provide a construction which eliminates torques generated by the roller mill and acting on the crank axis.

It is yet a further object of the invention to provide a drive for a pilger cold-rolling mill, where the torques exerted on the crank axis are balanced.

These and other object and advantages of the present invention will become evident from the description which follows.

2. Brief Description of the Invention

The present invention provides for a drive for a pilger cold-rolling mill with a mass and a torque balancing. A driven crank rotates around a vertical axis. A roller frame is guided horizontally in a guide. A coupler connects the driven crank with the roller frame. The coupler assumes, with its full mass, the balancing of momentum, and the crank assumes, with its full mass, the balancing of the masses. An additional mass has a center of mass ($S_M$) and is subjectable to a reciprocating motion synchronous and parallel to the roller frame. The center of mass ($S_M$) of the additional mass is disposed lower than the virtual engagement point ($S_{AG}$) of the centrifugal force of the crank balancing mass (MA). The product of the force of inertia for accelerating the additional mass ($M_Z$) and the vertical distance (b) between the center of mass ($S_M$) of the additional mass ($M_z$) and the engagement point ($S_{AG}$)of the centrifugal force of the mass (MA) corresponds to the mass moment to be balanced and is about equal to the product of the force of inertia engaging at the roller frame center of gravity ($S_{AG}$) and the vertical distance (a) of the roller frame center to the engagement point ($S_{AG}$) of the centrifugal force of the mass (MA).

The additional mass ($M_z$) can be disposed at the slider extended in the direction of motion of the roller frame. Preferably, the additional mass ($M_z$) is provided immediately below the roller frame ($W_G$) and the roller frame ($W_G$) is disposed on the slider extended in the direction of motion. A connection rod can be disposed between the slider and the coupler. A horizontal guide can confine the motion of the slider.

A drive shaft can provide driving power. A first bevel gear can be attached to an end of the drive shaft. A second bevel gear can engage the first bevel gear. A pinion can be solidly attached to the second bevel gear. A spur wheel can be attached to the second bevel gear for transferring rotary motion to the crank.

A pivot can connect the crank to the coupler. A pinion can be solidly connected to the pivot. An internally toothed gear wheel can surround the crank and the pinion can roll on the internally toothed gear wheel.

The roller frame can be disposed above the additional mass on the slider. The slider can be provided with an extended part and can take along the roller frame and the additional mass.

The slider can be shorter than the vertical projection of the distance between the crank axle and the additional mass. A connecting rod can be hingedly connected at its two ends with respective construction components for furnishing a connection between the slider and the coupler.

Preferably, the product of the vertical distance of the center of gravity of the additional mass from the engagement point of the centrifugal force of the mass-balancing mass times the additional mass is substantially equal to the product of the vertical distance of the point of engagement of the centrifugal force of the mass-balancing mass from the center of gravity of the roller frame times the roller frame mass.

A method for driving a pilger cold-rolling mill with a mass and a torque balancing comprises the following: A driven crank is rotated around a vertical axis. A roller frame is guided horizontally in the guide. The driven crank is connected with the roller frame by a coupler. The coupler assumes, with its full mass, the balancing of momentum and the crank assumes, with its full mass, the balancing of the masses. An additional mass having a center of mass ($S_M$) is subjected to a reciprocating motion synchronous and parallel to the roller frame. The center of mass ($S_M$) of the additional mass is disposed lower than the virtual engagement point ($S_{AG}$) of the centrifugal force of the crank balancing mass (MA). The product of the force of inertia for accelerating the additional mass ($M_z$) and the vertical distance (b) between the center of mass ($S_M$) of the additional mass ($M_z$) and the engagement point ($S_{AG}$) of the centrifugal force of the mass (MA) corresponds to the mass moment to be balanced is about and equal to the product of the force of inertia engaging at the roller frame center of gravity ($S_{AG}$) and the vertical distance (a) of the roller frame center to the engagement point ($S_{AG}$) of the centrifugal force of the mass (MA).

A connection rod can be disposed between the slider and the coupler. The motion of the slider can be confined with a horizontal guide.

The driving power can be provided with a drive shaft. A first bevel gear can be attached to an end of the drive shaft. A second bevel gear can be engaged with the first bevel gear. A pinion can be solidly attached to the second bevel gear. A spur wheel can be attached to the second bevel gear for transferring rotary motion to the crank.

A pivot can connect the crank to the coupler. A pinion can be solidly connected to the pivot. The crank can be surrounded with an internally toothed gear wheel. The pinion can be rolled on the internally toothed gear wheel.

The roller frame can be disposed above the additional mass on the slider. The slider can be furnished with an extended part and the slider can take along the roller frame and the additional mass.

A slider can be furnished which is shorter than the vertical projection of the distance between the crank axle and the additional mass. A connecting rod is hingedly connected at the two ends of each connecting rod with respective construction components for furnishing a connection between the slider and the coupler.

Preferably, the product of the vertical distance of the center of gravity of the additional mass from the engagement point of the centrifugal force of the mass balancing mass times the additional mass is substantially equal to the product of the vertical distance of the point of engagement of the centrifugal force of the mass-balancing mass from the center of gravity of the roller frame times the roller frame mass.

A balancing of the moment of inertia is made possible by a disposition of an additional mass below the roller frame and below the virtual point of engagement of the centrifugal force of the mass MA, if the vertical distance of the center of gravity of this additional mass from the engagement point of the centrifugal force of the mass balancing mass is selected such that its product is equal to the product resulting from the distance of the engagement point of the centrifugal force of the mass balancing mass from the center of gravity of the roller frame with the force of inertia engaged at the center of gravity of the roller frame.

In other words, the product of the vertical distance of the center of gravity of the additional mass from the engagement point of the centrifugal force of the mass-balancing mass times the additional mass is to be equal to the product of vertical distance of the point of engagement of the centrifugal force of the mass-balancing mass from the center of gravity of the roller frame times the roller frame mass.

According to a preferred embodiment of the invention, the additional mass is disposed at and below the slider extended in the direction of motion of the roller frame. The roller frame can be provided immediately above the coupler connecting rod, while the additional mass is attached, according to the preceding conditions, on the side next to the drive at the correspondingly extended slider.

According to a further embodiment, the additional mass is provided immediately below the roller frame, and the roller frame is disposed on the slider extended in the direction of motion. Here, the coupler engages at the end remote from the roller frame and transfers from there the drive force on the roller frame and on the additional mass.

According to a further embodiment, there can be provided a connecting rod between the slider and coupler.

The novel features which are considered as characteristic for the invention are set forth in the appended claims. The invention itself, however, both as to its construction and its method of operation, together with additional object and advantages thereof, will be best understood from the following description of specific embodiments when read in connection with the accompanying drawing.

BRIEF DESCRIPTION OF THE DRAWING

In the accompanying drawing, in which are shown several of the various possible embodiments of the present invention.

DESCRIPTION OF INVENTION AND PREFERRED EMBODIMENT

A drive for a pilger cold-rolling mill with a mass and a torque balancing, where the driven crank, rotating around a vertical axis, is connected via a coupler with a roller frame guided horizontally in a guide. The coupler assumes, with its full mass, the balancing of momentum and the crank assumes, with its full mass, the balancing of the masses. An additional mass $M_z$ is employed which can be subjected to a reciprocating motion synchronous and parallel to the roller frame. The center of gravity ($S_M$) of the additional mass is disposed lower than the virtual engagement point ($S_{AG}$) of the centrifugal force of the crank balancing mass (MA). The product of the force of inertia for accelerating the additional mass ($M_z$) and the vertical distance (b) between the center of gravity ($S_M$) of the additional mass ($M_z$) and the engagement point ($S_{AG}$) of the centrifugal force of the mass (MA) corresponds to the mass moment to be balanced and is about equal to the product of the force of inertia engaging at the roller frame center of gravity ($S_{AG}$) and the vertical distance (a) of the roller frame center to the engagement point ($S_{AG}$) of the centrifugal force of the mass (MA).

Preferably, the additional mass ($M_z$) is disposed at the slider 3 extended in the direction of motion of the roller frame. The additional mass ($M_z$) can be provided immediately below the roller frame ($W_G$) and the roller frame ($W_G$) can be disposed on the slider 3 extended in the direction of motion. A connection rod 15 can be provided between the slider 3 and the coupler 12.

Figure 1:
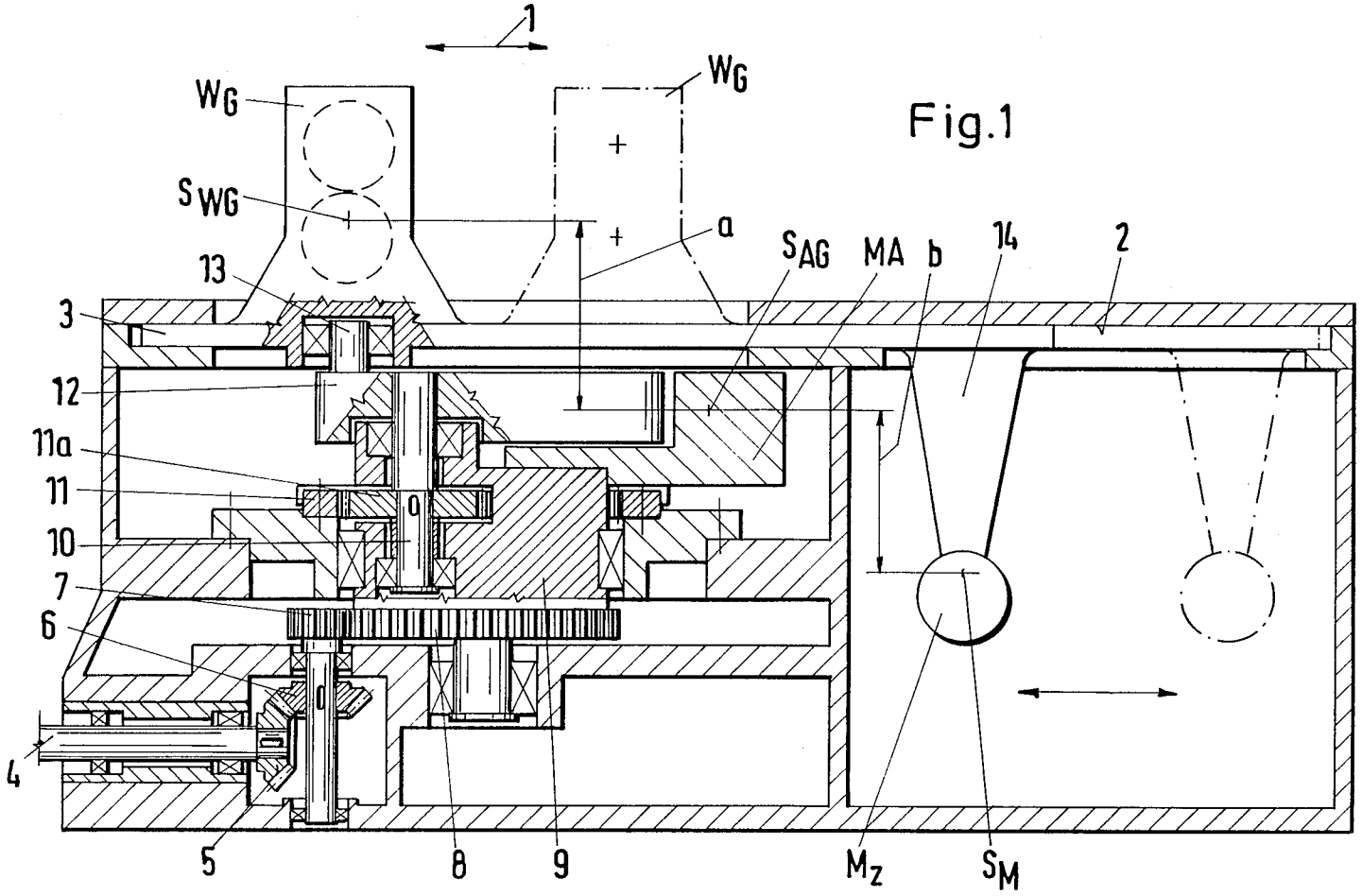
FIG. 1 is a schematic cross-section through a drive according to the invention for a pilger cold-rolling mill with an additional mass disposed at an extended slider.

The roller frame of the pilger cold-rolling mill is designated with $W_G$ in FIG. 1. The roller frame $W_G$ can be slid in the direction of arrow 1 between the end positions illustrated in full lines and in dash-dotted lines. The roller frame $W_G$ is here attached on the slider 3 movable horizontally in a guide 2. The motion of the slider 3 is generated by the crank drive. The drive, not illustrated, drives and transfers force via a drive shaft 4 and the bevel gear pair 5, 6 the rotary motion to the pinion 7 from which the spur wheel 8 is driven via the crank 9. The drive shaft is coupled to the drive via a coupler with a brake disk. The crank 9 assumes with its total mass MA the mass balancing. The crank 9 is connected to the coupler 12 via a pivot 10, where a pinion 11*a* is solidly connected to the pivot 10 and where the pinion 11*a* rolls on an internally geared toothed wheel 11 surrounding the crank 9. The coupler 12 receives by a corresponding superpositioning of the rotary motions a rotary motion which is opposite to that of the crank. The coupler 12 in turn is connected at 13 with the slider 3.

The center of gravity $S_{WG}$ of the roller frame $W_G$ is indicated in FIG. 1, where the engagement point $S_{AG}$ of the centrifugal force of the crank mass MA is at a vertical distance amounting to a value a. The force of inertia engaging in the center of gravity $S_{WG}$ of the roller frame is equal to the centrifugal force of the crank mass MA engaging at the engagement point $S_{AG}$. However, since the forces are not disposed on one and the same line of action, there results a mass force moment or a torque. The torque is the product of the centrifugal force of the roller frame at its center of mass times the length of lever arm. In order to balance this torque, it is provide according to the invention that an additional mass $M_z$ is employed, which is attached at the slide 3 at an arm 14. The center of mass of this additional mass $M_z$ has a distance from the engagement point of the centrifugal forces of the masses MA in a vertical plane, which is indicated with b, where the product of the force of inertia for accelerating the mass $M_z$ and the vertical distance b between the points $S_{AG}$ and $S_M$, acting as a lever arm, is equal to the mass force moment or torque of the roller frame to be balanced.

Figure 2:
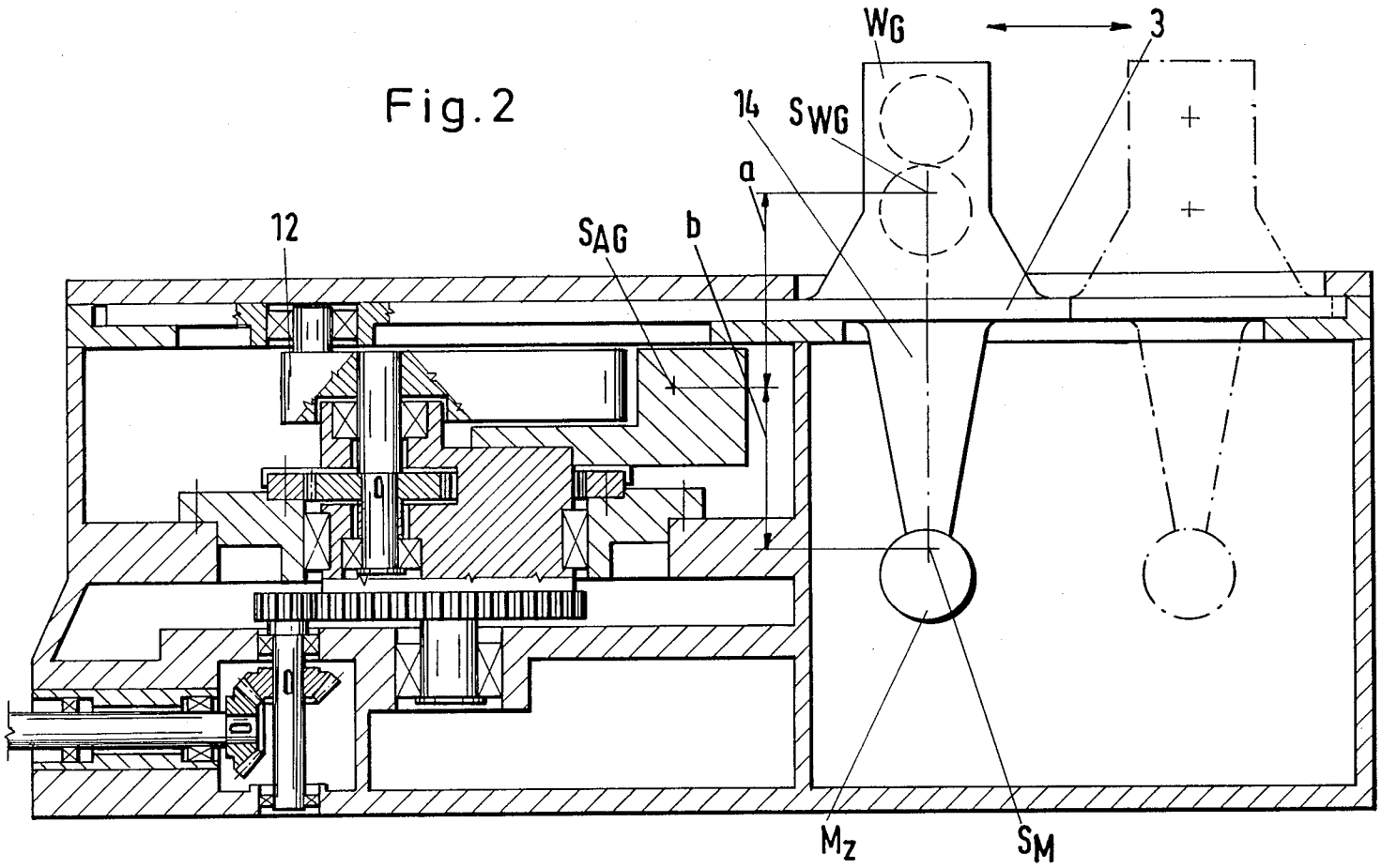
FIG. 2 is a schematic view of a drive where the roller frame is disposed on the extended slider above the additional mass.

FIG. 2 is similar to FIG. 1, however, the roller frame $W_G$ is disposed above the additional mass $M_z$ on the slider 3. The coupler 12 engages in this case into the extended part of the slider 3 and thereby takes along the roller frame $W_G$ and the additional mass $M_z$.

Figure 3:
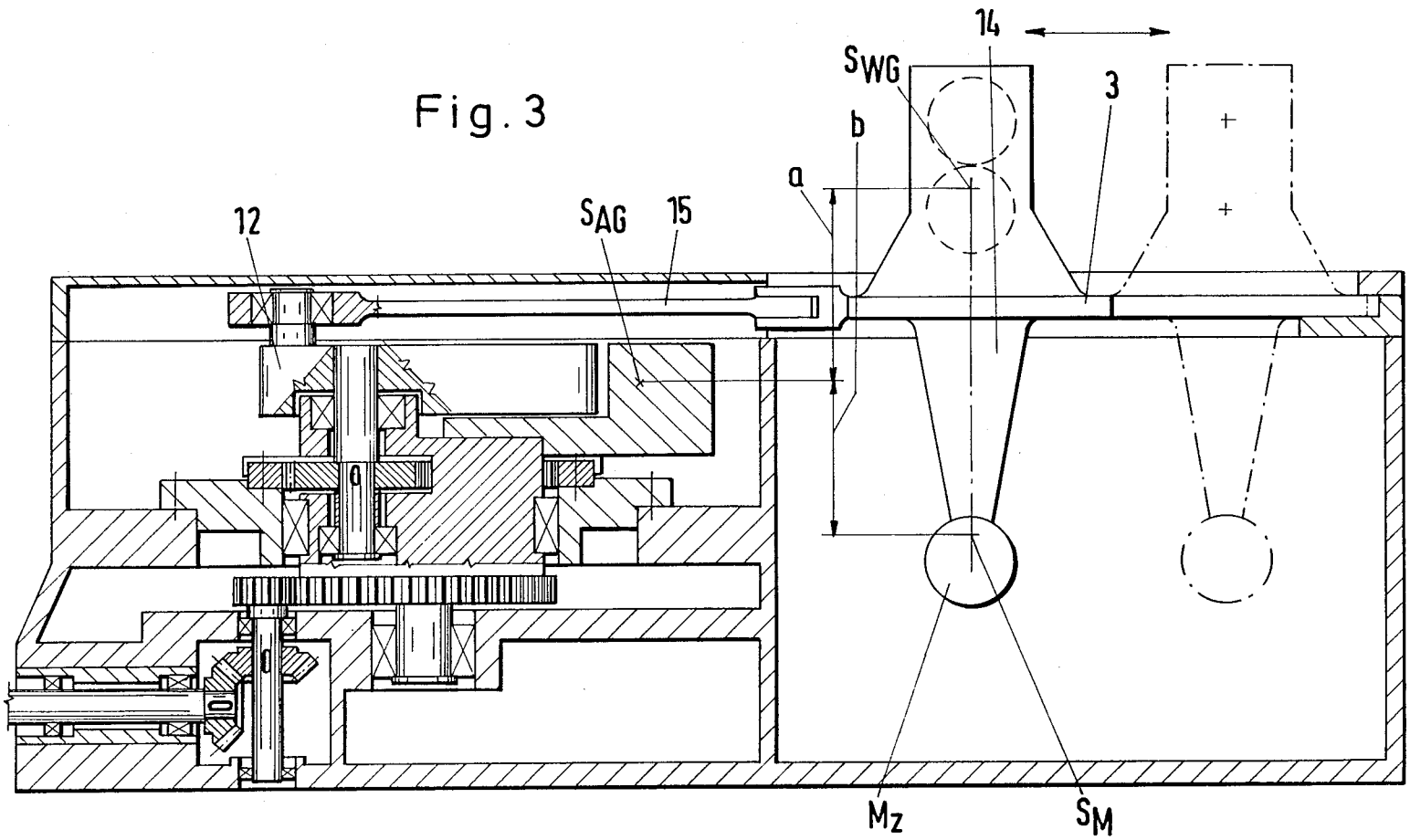
FIG. 3 is a view similar to that of FIG. 2, however, with a connecting rod between the slider and the coupler.

FIG. 3 distinguishes from the representation in FIG. 2 by having the slider 3 shortened and by providing the connection between the slider 3 and the coupler 12 by a connecting rod 15, which connecting rod is hingedly connected at its two ends with the respective construction components.

It will be understood that each of the elements described above, or two or more together, may also find a useful application in other types of roller mill drives differing from the types described above.

While the invention has been illustrated and described as embodied in the context of a drive for a pilger cold-rolling mill with a mass and a torque balancing, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

We claim:

1. A drive for a pilger cold-rolling mill with a mass and a torque balancing comprising a driven crank rotating around a vertical axis;

a guide;

a roller frame guided horizontally in the guide;

a coupler connecting the driven crank with the roller frame where the coupler assumes, with its full mass, the balancing of momentum and where the crank assumes, with its full mass, the balancing of the masses;

an additional mass having a center of mass ($S_M$) and subjectable to a reciprocating motion synchronous and parallel to the roller frame and where the center of mass ($S_M$) of the additional mass is disposed lower than a virtual engagement point ($S_{AG}$) of the centrifugal force of the crank balancing mass (MA), where a product of the force of inertia for accelerating the additional mass ($M_z$) and a vertical distance (b) between the center of mass ($S_M$) of the additional mass ($M_z$) and the virtual engagement point ($S_{AG}$) of the centrifugal force of the mass (MA) corresponds to the mass moment to be balanced and is about equal to the product of the force of inertia engaging at a roller frame center of gravity ($S_{AG}$) and the vertical distance (a) of the roller frame center to the engagement point ($S_{AG}$) of the centrifugal force of the mass (MA), wherein the additional mass ($M_z$) is provided immediately below the roller frame ($W_G$) and where the roller frame ($W_G$) is disposed on a slider extended in the direction of motion.

2. The drive for a pilger cold-rolling mill according to claim 1 further comprising a connection rod disposed between the slider and the coupler.

3. The drive for a pilger cold-rolling mill according to claim 2 further comprising a horizontal guide for confining the motion of the slider.

4. The drive for a pilger cold-rolling mill according to claim 1 further comprising a drive shaft providing driving power;

a first bevel gear attached to an end of the drive shaft;

a second bevel gear engaging the first bevel gear;

a pinion solidly attached to the second bevel gear;

a spur wheel attached to the second bevel gear for transferring rotary motion to the crank.

5. The drive for a pilger cold-rolling mill according to claim 1 further comprising a pivot connecting the crank to the coupler;

a pinion solidly connected to the pivot;

an internally toothed gear wheel surrounding the crank and where the pinion rolls on the internally toothed gear wheel.

6. The drive for a pilger cold-rolling mill according to claim 1 wherein the slider is shorter than the vertical projection of the distance between the crank axle and the additional mass; and further comprising a connecting rod hingedly connected at its two ends with respective construction components for furnishing a connection between the slider and the coupler.

7. The drive for a pilger cold-rolling mill according to claim 1 wherein the product of the vertical distance of the center of gravity of the additional mass from the engagement point of the centrifugal force of the mass-balancing mass times the additional mass is substantially equal to the product of the vertical distance of the point of engagement of the centrifugal force of the mass-balancing mass from the center of gravity of the roller frame times the roller frame mass.

8. A drive for a pilger cold-rolling mill with a mass and a torque balancing comprising a driven crank rotating around a vertical axis;

a guide;

a roller frame guided horizontally in the guide;

a coupler connecting the driven crank with the roller frame where the coupler assumes, with its full mass, the balancing of momentum and where the crank assumes, with its full mass, the balancing of the masses;

an additional mass having a center of mass ($S_M$) and subjectable to a reciprocating motion synchronous and parallel to the roller frame and where the center of mass ($S_M$) of the additional mass is disposed lower than a virtual engagement point ($S_{AG}$) of the centrifugal force of the crank balancing mass (MA), where a product of the force of inertia for accelerating the additional mass ($M_z$) and a vertical distance (b) between the center of mass ($S_M$) of the additional mass ($M_z$) and the virtual engagement point ($S_{AG}$) of the centrifugal force of the mass (MA) corresponds to the mass moment to be balanced and is about equal to the product of the force of inertia engaging at a roller frame center of gravity ($S_{AG}$) and the vertical distance (a) of the roller frame center to the engagement point ($S_{AG}$) of the centrifugal force of the mass (MA), wherein the roller frame is disposed above the additional mass on a slider;

the slider is provided with an extended part and where the slider takes along the roller frame and the additional mass.

9. The drive for a pilger cold-rolling mill according to claim 8, wherein the additional mass ($M_z$) is disposed at the slider extended in the direction of motion of the roller frame.

10. The drive for a pilger cold-rolling mill according to claim 8, wherein the additional mass ($M_z$) is provided immediately below the roller frame ($W_G$) and where the roller frame ($W_G$) is disposed on the slider extended in the direction of motion.

11. The drive for a pilger cold-rolling mill according to claim 8 further comprising a drive shaft providing driving power;

a first bevel gear attached to an end of the drive shaft;

a second bevel gear engaging the first bevel gear;

a pinion solidly attached to the second bevel gear;

a spur wheel attached to the second bevel gear for transferring rotary motion to the crank.

12. A drive for a pilger cold-rolling mill with a mass and a torque balancing, where a driven crank, rotating around a vertical axis, is connected via a coupler with a roller frame guided horizontally in a guide and where the coupler assumes, with its full mass, the balancing of momentum and where the crank assumes, with its full mass, the balancing of the masses, and wherein an additional mass $M_z$ is employed subjectable via a linking means to a reciprocating motion synchronous and parallel to the roller frame and where the center of gravity ($S_M$) of the additional mass is disposed lower than a virtual engagement point ($S_{AG}$) of the centrifugal force of the crank balancing mass (MA), where a product of the force of inertia for accelerating the additional mass ($M_z$) and a vertical distance (b) between the center of gravity ($S_M$) of the additional mass ($M_z$) and the virtual engagement point ($S_{AG}$) of the centrifugal force of the mass (MA) corresponds to the mass moment to be balanced and is about equal to the product of the force of inertia engaging at a roller frame center of gravity ($S_{AG}$)and the vertical distance (a) of the roller frame center to the engagement point ($S_{AG}$) of the centrifugal force of the mass (MA), and wherein the additional mass ($M_z$) is disposed at a slider (3) extended in the direction of motion of the roller frame.

13. The drive for a pilger cold-rolling mill according to claim 12, wherein the additional mass ($M_z$) is provided immediately below the roller frame ($W_G$).

14. A drive for a pilger cold-rolling mill according to claim 12, wherein a connection rod (15) is provided between the slider (3) and the coupler (12).

15. A method for driving a pilger cold-rolling mill with a mass and a torque balancing comprising rotating a driven crank around a vertical axis;

guiding a roller frame horizontally in a guide;

connecting the driven crank with the roller frame by a coupler, where the coupler assumes, with its full mass, the balancing of momentum and where the crank assumes, with its full mass, the balancing of the masses;

subjecting an additional mass having a center of mass ($S_M$) to a reciprocating motion synchronous and parallel to the roller frame and where the center of mass ($S_M$) of the additional mass is disposed lower than a virtual engagement point ($S_{AG}$) of the centrifugal force of the crank balancing mass (MA), where a product of the force of inertia for accelerating the additional mass ($M_z$) and a vertical distance (b) between the center of mass ($S_M$) of the additional mass ($M_z$) and the virtual engagement point ($S_{AG}$) of the centrifugal force of the mass (MA) corresponds to the mass moment to be balanced and is about equal to the product of the force of inertia engaging at a roller frame center of gravity ($S_{AG}$) and the vertical distance (a) of the roller frame center to the engagement point ($S_{AG}$) of the centrifugal force of the mass (MA);

disposing the roller frame above the additional mass on a slider;

furnishing the slider with an extended part and where the slider takes along the roller frame and the additional mass.

16. A method for driving a pilger cold-rolling mill with a mass and a torque balancing according to claim 15 further comprising disposing a connection rod between the slider and the coupler; and confining the motion of the slider with a horizontal guide.

17. A method for driving a pilger cold-rolling mill with a mass and a torque balancing according to claim 15 further comprising providing driving power with a drive shaft;

attaching a first bevel gear to an end of the drive shaft;

engaging a second bevel gear with the first bevel gear;

solidly attaching a pinion to the second bevel gear;

attaching a spur wheel to the second bevel gear for transferring rotary motion to the crank.

18. A method for driving a pilger cold-rolling mill with a mass and a torque balancing according to claim 15 further comprising a pivot connecting the crank to the coupler;

connecting a pinion solidly to the pivot;

surrounding the crank with an internally toothed gear wheel;

and rolling the pinion on the internally toothed gear wheel.

19. A method for driving a pilger cold-rolling mill with a mass and a torque balancing according to claim 15 further comprising furnishing a slider which is shorter than the vertical projection of the distance between the crank axle and the additional mass; and further comprising hingedly connecting a connection rod at the two ends with respective construction components for furnishing a connection between the slider and the coupler.

20. A method for driving a pilger cold-rolling mill with a mass and a torque balancing according to claim 15 wherein the product of the vertical distance of the center of gravity of the additional mass from the engagement point of the centrifugal force of the mass balancing mass times the additional mass is substantially equal to the product of the vertical distance of the point of engagement of the centrifugal force of the mass-balancing mass from the center of gravity of the roller frame times the roller frame mass.

* * * * *